United States Patent [19]

Cheung et al.

[11] 4,306,627

[45] Dec. 22, 1981

[54] FLUID JET DRILLING NOZZLE AND METHOD

[75] Inventors: John B. Cheung, Bellevue; Scott D. Veenhuizen, Kent, both of Wash.

[73] Assignee: Flow Industries, Inc., Kent, Wash.

[21] Appl. No.: 13,884

[22] Filed: Feb. 21, 1979

Related U.S. Application Data

[63] Continuation of Ser. No. 835,536, Sep. 22, 1977, abandoned.

[51] Int. Cl.[3] ..... E21B 10/60

[52] U.S. Cl. ..... 175/422; 175/67; 299/17

[58] Field of Search ..... 175/422, 65, 67; 299/17; 239/600

[56] References Cited

U.S. PATENT DOCUMENTS

| | | | |
|---|---|---|---|
| 2,783,972 | 3/1957 | Fehlmann | 175/422 |
| 2,950,090 | 8/1960 | Swart | 175/340 |
| 3,120,284 | 2/1964 | Goodwin | 239/600 |
| 3,389,759 | 6/1968 | Mori | 175/258 |
| 3,542,142 | 12/1970 | Hasiba et al. | 175/422 X |
| 3,645,346 | 2/1972 | Miller et al. | 175/422 |
| 3,688,852 | 9/1972 | Gaylord | 175/393 |
| 3,705,693 | 12/1972 | Franz | 239/600 |
| 3,746,108 | 7/1973 | Hall | 175/422 |
| 3,927,723 | 12/1975 | Hall | 175/422 |
| 4,062,403 | 12/1977 | Sparlin | 166/156 |

FOREIGN PATENT DOCUMENTS 445739 7/1971 U.S.S.R. .

*Primary Examiner*—William F. Pate, III
*Attorney, Agent, or Firm*—Dowrey & Cross

[57] ABSTRACT

A fluid jet drilling nozzle and associated drilling method. The nozzle is adapted to be connected to a source of high pressure fluid and to be rotated about a rotation axis, and comprises a body formed so that it partially encloses a cavity, which cavity is in fluid communication with the source of high pressure fluid when the nozzle is connected to such source. The nozzle further comprises means for allowing high pressure fluid in the cavity to exit the nozzle in the form of a high velocity fluid jet which intersects the axis of rotation of the nozzle. Such a nozzle may be mounted in any drilling apparatus capable of supplying high pressure fluid to the cavity and of rotating or oscillating the nozzle about its rotation axis.

8 Claims, 5 Drawing Figures

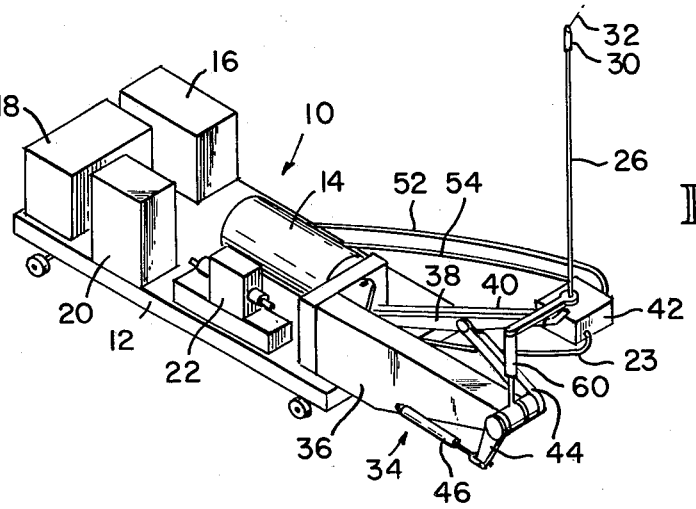
FIG. 1
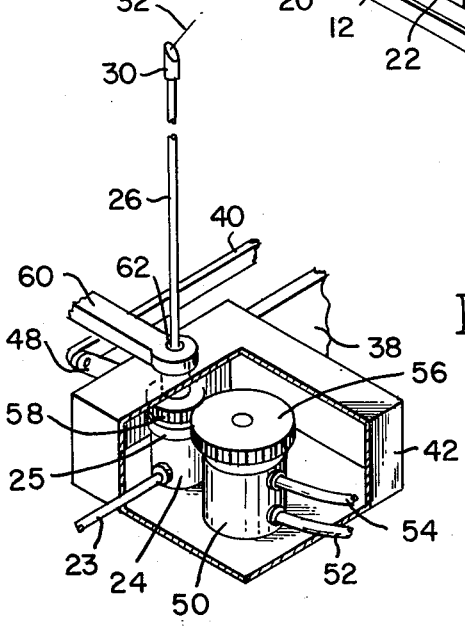
FIG. 2
FIG. 3
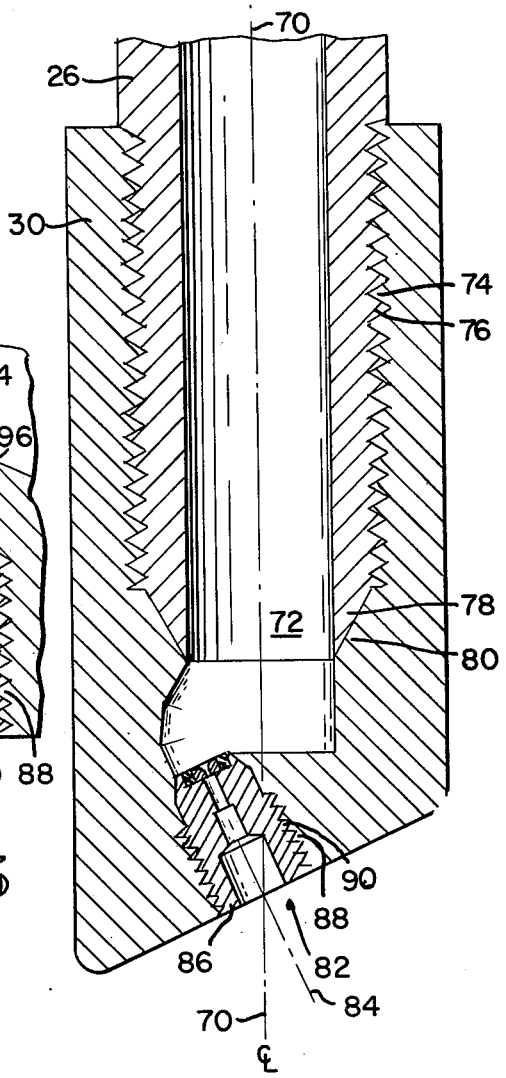
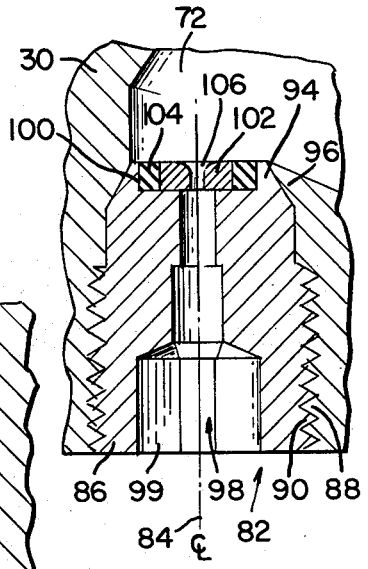
FIG. 5
FIG. 4
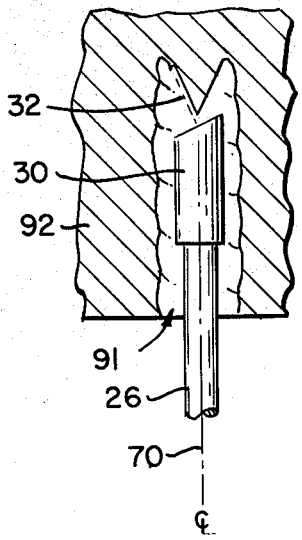

FLUID JET DRILLING NOZZLE AND METHOD

This is a continuation, of application Ser. No. 835,536, filed Sept. 22, 1977, now abandoned.

BACKGROUND OF THE INVENTION

This invention relates to fluid jet drilling nozzles and methods for fluid jet drilling.

Although high velocity fluid jets have found a considerable number of applications in the cutting or scoring of various materials, the use of fluid jets for drilling in rock or other substances have received relatively little attention. One of the problems inherent in fluid jet drilling is that the fluid jets lose much of their cutting ability if the jet forming nozzle is too great a distance from the surface being cut. It is therefore necessary for a fluid jet drilling technique to be capable of drilling a hole of large enough diameter for the drilling nozzle to enter, so that the nozzle may be advanced into the hole as it is cut. Fluid jets, however, are of quite small diameter, typically 0.01 inches, and therefore at any one instant the jet can only cut against a very small area of the rock. A practical technique is therefore needed by which a small diameter fluid jet can cut a hole having a diameter much larger than the jet.

SUMMARY OF THE INVENTION

This invention provides a fluid jet drilling nozzle and an associated drilling method by which a single fluid jet can drill a hole of diameter sufficient to allow the drilling nozzle to enter.

The nozzle is adapted to be connected to a source of high pressure fluid and to be rotated about a rotation axis, and comprises a body formed so that it partially encloses a cavity, which cavity is in fluid communication with the source of high pressure fluid when the nozzle is connected to such source. The nozzle further comprises means for allowing high pressure fluid in the cavity to exit the nozzle in the form of a high velocity fluid jet which intersects the axis of rotation of the nozzle. The means for allowing the high pressure fluid to exit the nozzle may comprise a passage forming element which is removable from the body.

Such a nozzle may be mounted in any drilling apparatus capable of supplying high pressure fluid to the cavity and of rotating or oscillating the nozzle about its rotation axis. The apparatus may also be capable of advancing the nozzle as a hole is drilled. Although nozzles according to the present invention may comprise additional jet forming elements to optimize certain drilling applications, a nozzle forming a single jet as described herein is fully capable of efficiently drilling a hole large enough for such nozzle to enter.

These and other features and advantages of the invention will be apparent from the detailed description and claims to follow taken in conjunction with the accompanying drawings.

BRIEF DESCRIPTION OF THE DRAWINGS

FIG. 1 is a perspective view of a fluid jet drilling apparatus including a nozzle according to the present invention;

FIG. 2 is an expanded view of the drilling portion of the apparatus of FIG. 1;

FIG. 3 is a cross sectional view of a nozzle according to the present invention;

FIG. 4 is a cut away side elevational view of a nozzle according to the present invention and a hole drilled thereby; and FIG. 5 is a cross sectional view of the jet forming area of the nozzle of FIG. 3.

DETAILED DESCRIPTION OF THE DRAWINGS

FIG. 1 depicts a fluid jet ddrilling apparatus 10 designed for drilling holes for roof bolts in mines. The present invention may be practiced using such an apparatus, or using any other apparatus capable of supplying high pressure fluid to a nozzle and of rotating such nozzle about an axis.

The apparatus of FIG. 1 comprises a wheeled cart 12 on which are mounted electric motor 14, starter 16 for the motor, reservoir 18, hydraulic pump 20, and fluid intensifier 22. Such elements are depicted schematically, inasmuch as they are conventional and do not of themselves form part of the present invention. Electric motor 14 drives hydraulic pump 20, which pump supplies comparatively low pressure fluid (e.g. 3000 psi) to intensifier 22. The intensifier draws fluid such as water from reservoir 18 and discharges such fluid at a high pressure, typically 20,000–60,000 psi. This high pressure fluid is supplied, by tubing shown in part at 23 in FIG. 2, to high pressure swivel 24, from where it passes through rotatable, tubular drill stem 26 to nozzle 30. The nozzle causes the high pressure fluid to be emitted therefrom in the form of a high velocity (e.g. 1200 ft/sec) fluid jet 32, as hereafter described in greater detail. Such jets are coherent streams of fluid which typically have diameters in the range of 0.002 to 0.03 inches.

Drilling appartus 10 of FIG. 1 also comprises means, generally indicated at 34, for mounting drill stem 26 and nozzle 30 such that they can be rotated and can be moved along the axis of such rotation. Such means includes rigid support member 36 extending horizontally from cart 12, arms 38, 40 extending between support member 36 and housing 42, bell crank 44 mounted at the end of support member 36 and pivotally connected at one end to arm 38, and hydraulic cylinder 46 mounted between support member 36 and the other end of bell crank 44. Arms 38, 40 are jointly mounted at their respective lower ends of support member 36 near cart 12 such that the lower ends of such arms may slide horizontally in unison along the support member. The upper end of arm 38 is pivotally connected to housing 42 whereas the upper end of arm 40 is pivotally connected to link 48 extending from the housing and rigidly connected thereto.

Raising and lowering of housing 42 is accomplished by actuation of hydraulic cylinder 46, which cylinder rotates bell crank 44. Because the lower ends of arms 38, 40 are free to slide horizontally, rotation of bell crank 44 causes the upper ends of such arms and housing 42 to move up or down without horizontal motion. During such up and down motion, arms 38, 40 and link 48 act as a parallelogram assembly to maintain housing 42 in fixed orientation with respect to support member 36, and therefore with respect to the remainder of the drilling apparatus 10.

As described above, high pressure fluid enters high pressure swivel 24 (FIG. 2) through tubing 22 and passes therefrom into tubular drill stem 26 and finally to nozzle 30. High pressure swivel 24 is mounted in housing 42 and comprises a rotatable portion 25 to which drill stem 26 is secured. Rotation of drill stem 26 is accomplished by means of hydraulic motor 50 also mounted in housing 42. Fluid lines 52, 54 connect motor 50 to an auxiliary hydraulic pump (not shown) mounted on cart 12 and driven by electric motor 14. Motor 50 drives gear 56 which in turn drives gear 58 mounted on drill stem 26 concentrically therewith. Although drilling apparatus 10 provides means for the continuous rotation of nozzle 30, it is to be understood that the present invention could also be practiced using a drilling apparatus which rotated the nozzle in back and forth or oscillatory manner.

In FIGS. 1 and 2, nozzle 30 and drill stem 26 are shown in their upwardly extended positions, which positions they would normally assume upon completion of drilling a particular hole. In such positions, the nozzle would extend into the hole and the hole itself would therefore serve to prevent the nozzle and the drill stem from substantial horizontal bending or oscillation. When the nozzle and drill stem are in a lowered position, as during the initial stage of drilling a hole, this same function is served by guide 60 mounted on support member 36. Guide 60 terminates in collar 62 surrounding drill stem 26, such collar limiting horizontal bending or oscillation of the drill stem particularly when it is in its lowered position.

FIG. 3 presents a cross sectional view of nozzle 30 and of the associated end of drill stem 26. Nozzle 30 has a cylindrical outer shape and a central axis 70 which is also the central axis of tubular drill stem 26. Axis 70 is the axis about which nozzle 30 and drill stem 26 are rotated by drilling apparatus 10.

Nozzle 30 contains a cylindrical cavity 72 therein, which cavity is open at the rear end of the nozzle (upper end in FIG. 3). The walls lining the rearward end of cavity 72 contain threads 74 matched to threads 76 on the outer surface of drill stem 26, by which means the nozzle may be secured to the drill stem as shown. A frusto-conical tapered section 78 at the end of drill stem 26 is matched by a similarly tapered section 80 in the walls lining the cavity, such tapered sections forming a seal to prevent high pressure fluid passing from the interior of drill stem 26 into cavity 72 from escaping past threads 74, 76.

The forward end of nozzle 30 (lower end in FIG. 3) contains a cylindrical recess 82 within each cylindrical jet forming element 86 is mounted by means of threads 88 on the inner wall of recess 82 and threads 90 on the outer walls of jet forming element 86. Recess 82 is continuous with cavity 72, and jet forming element 86 therefore extends between cavity 72 and the exterior of the nozzle. As described in detail below, jet forming element 86 receives high pressure fluid from cavity 72, converts such fluid into a high velocity fluid jet, and directs such jet along line 84, which line is also the central axis of the jet forming element. Line 84 is inclined to about 30° with respect to rotation axis 70 and, most importantly intersects the rotation axis at the outer surface of nozzle 30. The reasons for directing the fluid jet in this manner may be appreciated by reference to FIG. 4, which depicts a hole 91 being drilled in material 92 by drilling nozzle 30 mounted on drill stem 26 and emitting fluid jet 32. As nozzle 30 rotates about rotation axis 70 and simultaneously advances into hole 91, jet 32 sweeps out and removes successive cones of material 92. However in order that it be possible at any given time to advance nozzle 30 into material 92, it is necessary that all material immediately in front of nozzle 30 should have previously been removed by jet 32. This will be the case when jet 32 intersects the axis of rotation of the nozzle at a point at or exterior to the outer surface of the nozzle. A single rotatable fluid jet, so directed, is capable of efficiently cutting holes of a size sufficient to allow the drilling nozzle to enter. The point at which the jet intersects the axis of rotation, as well as the angle at which it is inclined with respect thereto, may be adjusted to suit different materials being cut, the intersection point and angle shown in FIG. 4 being typical for drilling in rock of average hardness.

FIG. 5 presents a detailed view of jet forming element 86. The outer wall of such element contains threads 90, as already described, as well as a frusto-conical tapered section 94 engagable with a matching tapered section 96 in the wall of recess 82 so as to form seal therebetween. The interior of jet forming element 86 contains a stepped cylindrical, passage 98 extending entirely through said element, the central axis of such passage coinciding with line 84. The outermost portion 99 of passage 98 has a hexagonal shape to facilitate insertion and removal of jet forming element 86 into and from the body of nozzle 30. The interior surface of element 86 (upper surface in FIG. 3) contains a shallow cylindrical recessed portion 100 which is concentric with passage 98. Jewel element 102 contains a central cylindrical orifice 106 therein and is mounted in recessed portion 100 by rubber ring 104 such that orifice 106 is centered on line 84 with its central axis coincident therewith. Jewel element 102 forms and directs jet 32 along line 84, and orifice 106 has a diameter corresponding to the desired diameter of the jet.

While the preferred embodiment of this invention has been illustrated and described herein, it should be understood that variations will become apparent to one skilled in the art. Accordingly, the invention is not to be limited to the specific embodiment illustrated and described herein and the true scope and spirit of the invention are to be determined by reference to the appended claims.

What is claimed is:

1. A fluid jet drilling nozzle comprising:

a nozzle body, said nozzle body having a cavity therein;

means for connecting said nozzle body to a source of high-pressure fluid to introduce high-pressure fluid into said cavity;

jet forming means mounted in said nozzle body in fluid communication with said cavity for forming a single cutting jet of high-pressure fluid; said cutting jet being the sole drilling means; and means for rotating said jet forming means about an axis of rotation, said cutting jet being directed to intersect said axis of rotation at or beyond the surface of said nozzle, the angle of said cutting jet and the pressure of said high-pressure fluid being such that successive cones of material are cut and removed for drilling a hole of greater diameter than the maximum diameter of said nozzle body as the jet forming means is rotated and the nozzle body advanced, whereby a single fluid jet drills a hole of sufficient diameter to allow the drilling nozzle to enter.

2. A fluid jet drilling nozzle according to claim 1 including a frusto-conical cavity portion inside said nozzle body for sealingly engaging an end of a drill stem to control high-pressure fluid leakage between said drill stem and said nozzle body.

3. A fluid jet drilling nozzle comprising:

a nozzle body, said nozzle body having a cavity therein;

means for connecting said nozzle body to a source of high-pressure fluid to introduce high-pressure fluid into said cavity;

jet forming means mounted in said nozzle body in fluid communication with said cavity for forming a cutting jet of high-pressure fluid;

means for rotating said jet forming means about an axis of rotation, said cutting jet being directed to intersect said axis of rotation for cutting and removing cones of material for drilling a hole of greater diameter than said nozzle body;

a passage extending into said nozzle body, said passage including a frusto-conical tapered passage section with the smaller diameter end thereof being connected to said cavity; and a cylindrical passage section extending from the larger diameter end of said frusto-conical passage section to a surface of said nozzle body, said jet forming means being demountably engaged with said passage, said jet forming means having a cylindrical outer section corresponding to said cylindrical passage section and a frusto-conical end section corresponding to said frusto-conical tapered passage section for sealing engagement therewith.

4. A fluid jet drilling nozzle according to claim 3 wherein said jet forming means includes a cylindrical bore therethrough in fluid communication with said cavity; and a jewel element mounted in said cylindrical bore, said jewel element having an orifice therein for forming said cutting jet and for directing said cutting jet along a line such that said cutting jet intersects said axis of rotation.

5. A fluid jet drilling nozzle according to claim 4 wherein said cylindrical bore includes a plurality of cylindrical steps, said jewel element being mounted in one of said cylindrical steps; and an elastomeric seal ring between said jewel element and said cylindrical bore to control high-pressure fluid leakage therebetween.

6. A fluid jet drilling nozzle according to claim 5 or claim 4 wherein said cylindrical bore includes means for engaging a tool to rotate said jet forming element within said passage for selectively inserting said jet forming element within said passage and for removing said jet forming element therefrom.

7. A fluid jet drilling nozzle, comprising:

a nozzle body, said nozzle body including means for connecting said nozzle body to a drill stem, said nozzle body including a cavity therein, said cavity having a cylindrical cavity portion and a frusto-conical cavity portion with the larger diameter end thereof being connected to said cylindrical cavity portion whereby an end of said drill stem projects through said cylindrical cavity portion and the end of said drill stem sealingly engages said frusto-conical cavity portion to control high-pressure fluid leakage about said drill stem;

a passage extending through said nozzle body, said passage including a frusto-conical tapered passage section with the smaller diameter end thereof being connected to said cavity, and a cylindrical passage section extending from the larger diameter end of said frusto-conical passage section to a surface of said nozzle body;

a jet forming element for forming a cutting jet, said jet forming element being demountably engaged with said passage, said jet forming element having a cylindrical outer section corresponding to said cylindrical passage section and a frusto-conical end portion corresponding to said frusto-conical tapered passage section for sealing engagement therewith, said jet forming element having a cylindrical bore therethrough in fluid communication with said cavity with the axis of said cylindrical bore intersecting the longitudinal axis of said nozzle body, said jet forming element having a jewel element mounted in said cylindrical bore, said jewel element having an orifice therein for forming said cutting jet and for directing said cutting jet along a line parallel to the axis of said cylindrical bore such that said cutting jet intersects the longitudinal axis of said nozzle body at a point exterior to said nozzle body; and means for rotating said cutting jet about said longitudinal axis of said nozzle body for cutting and removing cones of material for drilling a hole of greater diameter than that of said nozzle body.

8. A fluid jet drilling nozzle according to, claim 3, claim 4 or claim 7 wherein said jet forming means forms a single cutting jet.

* * * * *